United States Patent [19]

Braun

[11] Patent Number: 4,530,668

[45] Date of Patent: Jul. 23, 1985

[54] APPARATUS FOR WALKING UPON WATER

[76] Inventor: Henry D. Braun, 2421 84 Ave., S.E., Calgary, Alberta, Canada, T2C 0K7

[21] Appl. No.: 615,172

[22] Filed: May 30, 1984

[51] Int. Cl.[3] ..... A63C 15/03

[52] U.S. Cl. ..... 441/76; 114/354

[58] Field of Search ..... 441/65, 61, 76, 77, 441/79; 114/288, 290, 353, 354; 440/17, 98

[56] References Cited

U.S. PATENT DOCUMENTS

| | | | |
|---|---|---|---|
| 1,341,290 | 5/1920 | Webster | 441/61 |
| 1,552,845 | 9/1925 | Knobloch | 441/77 |
| 1,636,316 | 7/1927 | Noesske | 441/60 |

*Primary Examiner*—Sherman D. Basinger

*Attorney, Agent, or Firm*—Norman B. Rainer

[57] ABSTRACT

A flotation device is provided for enabling a person to stride upon a body of water. The device, to be worn on each foot of the user, is comprised of a series of horizontally elongated parallel keels, and flaps pivotably suspended from the keels. When downward force is applied to the device in the water, the flaps pivot upwardly to form roofs of channels between adjacent keels. When the device is lifted from the water, the flaps swing downwardly, thereby breaking any suction effect which would cause retention of water within the channel. Such mode of operation improves the ease with which the device is lifted from the water in walking or skating motion.

8 Claims, 4 Drawing Figures

APPARATUS FOR WALKING UPON WATER

BACKGROUND OF THE INVENTION

This invention concerns apparatus which can be attached to a person's feet to enable such person to walk or skate upon the surface of a body of water.

Many devices have in the past been proposed to enable a person to walk or skate upon the surface of a body of water. Most of such devices are rigid pontoon-type structures which are cumbersome to manipulate and provide little positional stabilization by interaction with the water. The generally large size of said pontoon-type devices further leads to inconvenience in their storage and transportation.

It is accordingly an object of the present invention to provide improved apparatus for enabling a person to traverse the surface of a body of water in substantially upright posture.

It is another object of this invention to provide apparatus as in the foregoing object having improved ease of manipulation and improved positional stability with respect to the body of water.

It is a further object of the present invention to provide apparatus of the aforesaid nature having a collapsible construction whereby it occupies less space when not in use.

It is still another object of the present invention to provide apparatus of the aforesaid characteristics of rugged construction and capable of economical manufacture.

These objects and other objects and advantages of the invention will be apparent from the following description.

SUMMARY OF THE INVENTION

The above and other beneficial objects and advantages are accomplished in accordance with the present invention by an improved apparatus which comprises a pair of identical flotation devices, each device comprised of:

(a) an array of vertically oriented horizontally elongated keel panels in parallel, spaced-apart juxtaposition defining elongated channels, said keel panels having straight upper edges which lie in coplanar disposition, (b) at least two transverse members which pivotably engage the upper edges of said keel panels in a manner to permit adjustment of the spacing between the keel panels from a maximum spacing corresponding to the functional state of the device to a minimum spacing corresponding to the storage state of the device, (c) at least one horizontally elongated flap disposed within each channel in hinged attachment with a keel panel adjacent its upper edge and adapted for movement between a lowermost position wherein said flap lies flush against the panel to which it is attached, and an uppermost position wherein said flap is substantially perpendicularly disposed to said panel and constitutes a roof for said channel, and (d) foot mounting means disposed above the upper edges of said keel panels and substantially centered within said array of keel panels.

In use, a device is attached to each foot of the user. As the user is flotatively supported by the devices, the flaps are in their uppermost position. When the user lifts the device out of the water to transport it forwardly in a striding motion, the flaps pivot to their lowermost position. Such action makes it easier to lift the device from the water, because otherwise, the suction effect caused by the water's action against the roof of the channels would greatly increase the force needed to lift the device from the water. When the device, following transport to a forward location, is placed back in the water, the buoyancy of the flaps causes them to pivot to their uppermost position where they constitute the roofs of the channels and thereby enable the device to flotatively support the user.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
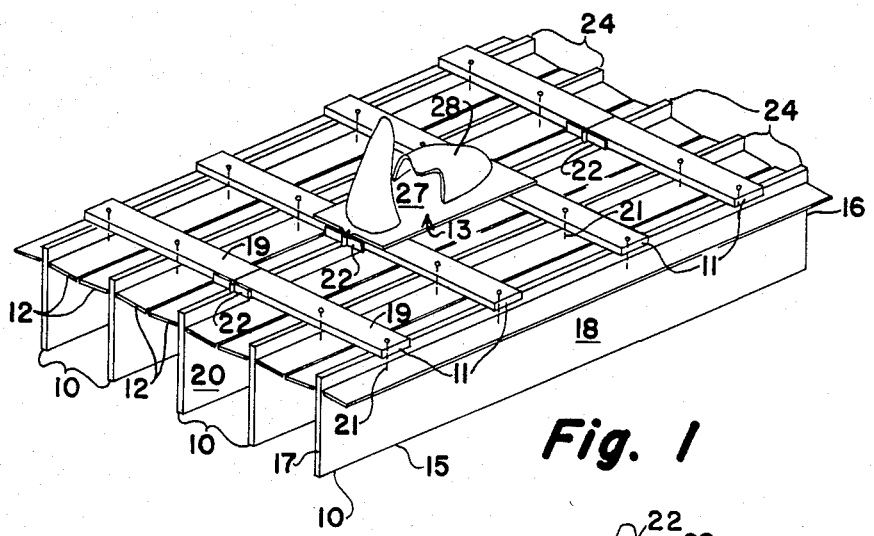
FIG. 1 is a perspective view of an embodiment of one of the devices of the present invention.

For ease of description, the expressions "forward" or "front", and "rear" or "back" or terms of similar import will have reference to the right-hand and left-hand portions, respectively, of the device shown in FIG. 1. Likewise, the expressions "upper" or "top" and "lower" or "bottom" will relate to the upper and lower portions, respectively, of the device illustrated in FIG. 2.

DESCRIPTION OF THE PREFERRED EMBODIMENT

Figure 2:
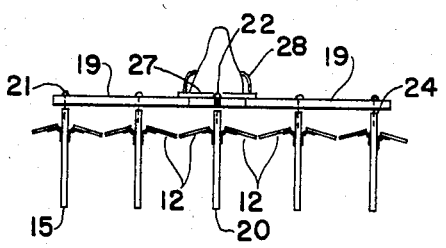
FIG. 2 is an end view of the device of FIG. 1 in its flotatively supportive configuration.
Figure 3:
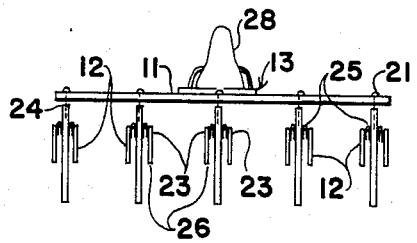
FIG. 3 is an end view of the device of FIG. 1 in its transport configuration.

Referring to FIGS. 1, 2 and 3, a device of the present invention is shown comprised of five identical keel panels 10 of horizontally elongated rectangular configuration disposed in a parallel array, four transverse members 11 which engage the upper edges 24 of said keel panels, flaps 12 hingedly associated with keel panels 10, and foot mounting means 13 centrally located upon the upper portion of the device.

Each keel panel 10 is comprised of buoyant, rigid, flat sheet stock material such as plywood or closed-cell polymer foam slab and adapted to survive prolonged immersion in water. Each keel panel 10 has a generally rectangular periphery defined by straight upper edge 24, lower edge 15, forward edge 16, and rearward edge 17. Although the forward and rearward edges need not necessarily be straight, as in a perfect rectangular format, upper edge 24 must be straight, and lower edge 15 is preferably straight. The length of the keel panels, measured horizontally between forward and rearward edges, may range from 2 to 6 feet. The height of the keel panels, measured vertically between upper and lower edges, may range from 3 to 6 inches. The ratio of length to height of the keel panels is preferably between about 7 and 20.

The keel panels not only provide flotation but stabilize the device with respect to lateral movement in the water. Although larger sized keel panels provide greater flotation and stability, dimensions greater than those recited above may cause the user difficulty in maneuvering the devices. The number of keel panels may range from between about 4 and 10, and the total width of the device, measured horizontally between exterior surfaces 18 of the exterior keel panels, is between about 10 and 20 inches. The greater widths of the device favor resistance to tilting movements in the direction transverse to the direction of elongation of the keel panels.

Figure 4:
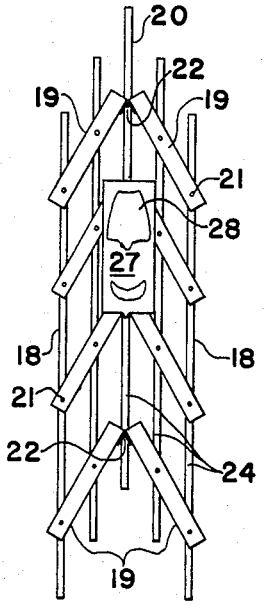
FIG. 4 is a plan view of the device of FIG. 1 in its collapsed, storage configuration.

The function of the transverse members is to hold the keel panels in their desired positions without interference with the function of the device. The transverse members 11 of the illustrated embodiment are each comprised of half portions 19 which are pivotably interengaged by pivot means 22 which engage the upper edge of center keel member 20. Each half portion 19 further engages the other keel panels at their upper edges by pivot pins 21. By virtue of such manner of construction, the device can be collapsed to a compact configuration suitable for storage or shipment, as shown in FIG. 4. Although the site of pivoted joinder of half portions 19 in the illustrated embodiment is shown to further engage center keel panel 20 in an odd-numbered array of keel panels, said site of pivoted joinder need not necessarily be further engaged with a keel panel. Accordingly, even-numbered arrays of keel panels may suitably be employed.

The flaps 12 of the illustrated embodiment are of elongated generally rectangular configuration, having a straight upper or proximal edge 23 which is attached by hinge means 25 to keel panel 10 adjacent its upper edge 24, and straight lower or distal edge 26. When paired flaps are utilized, as in the preferred, illustrated embodiment, both flaps of each pair are substantially identical and are dimensioned and positioned in a manner such that distal edges 26 make close-fitting contact when the flaps are in their uppermost position corresponding to the flotatively supportive configuration of the device. It is important to note that position limiting means must be associated with flaps 12 to limit the extent of their upward motion. Such limiting means may constitute the abutment of distal edges 26 as in the illustrated embodiment, or may involve separate and distinct additional abutment structures. The flaps are constructed of flat rigid buoyant sheet stock such as plywood or closed-cell foamed polymer. The undersides of the flaps may be provided with pocket-like structures to entrap air in the upward position, thereby creating greater buoyancy of the channels in the roofed state.

Foot mounting means 13 is shown comprised of rigid buoyant base panel 27 positioned atop two transverse members 11 and attached via pivot means 22 to the upper edge of center keel panel 20, and flexible heel and toe fittings 28 attached to said base panel. By virtue of the centered position of the foot mounting means, it does not interfere with the collapsing movement of the device. The foot mounting means further provides ease of engagement and disengagement of the user's foot while further affording good manipulative control of the device.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A flotation device adapted to be worn on each foot of a person for enabling the person to traverse the surface of a body of water, comprising:

(a) an array of vertically oriented horizontally elongated buoyant keel panels in parallel, spaced-apart juxtaposition defining elongated channels, said keel panels having straight upper edges which lie in coplanar disposition, (b) at least two transverse members which pivotably engage the upper edges of said keel panels in a manner to permit adjustment of the spacing between the keel panels from a maximum spacing corresponding to the functional state of the device to a minimum spacing corresponding to the storage state of the device, (c) at least one horizontally elongated buoyant flap disposed within each channel in hinged attachment with a keel panel adjacent the upper edge thereof and adapted for movement between a lowermost position wherein said flap lies flush against the panel to which it is attached, and an uppermost position wherein said flap is substantially perpendicularly disposed to said panel and constitutes a roof for said channel, and (d) foot mounting means disposed above the upper edges of said keel panels and substantially centered within said array of keel panels.

2. The device of claim 1 wherein the movement of the flaps to said lowermost position is caused by gravity force, and movement to said uppermost position is caused by the buoyant force of water acting against the flap.

3. The device of claim 2 wherein said flaps are of rectangular configuration, having straight horizontally disposed upper and lower edges.

4. The device of claim 3 wherein said flaps are arranged in pairs between said keel panels.

5. The device of claim 4 wherein the lower edges of said paired flaps are brought into abutting contact in the uppermost position of said flaps.

6. The device of claim 5 wherein the ratio of length to height of the keel panels in between 7 and 20.

7. The device of claim 6 wherein the number of keel panels is between 4 and 10.

8. The device of claim 2 wherein said transverse members are comprised of two halves pivotably joined at the center of the device.

* * * * *